United States Patent [19]

Kuchenbecker

[11] Patent Number: 4,546,884

[45] Date of Patent: Oct. 15, 1985

[54] TEAR STRIP END CLOSURE ON LIQUID TIGHT CARTON

[75] Inventor: Morris W. Kuchenbecker, Neenah, Wis.

[73] Assignee: James River - Norwalk, Inc., Norwalk, Conn.

[21] Appl. No.: 548,089

[22] Filed: Nov. 2, 1983

[51] Int. Cl.[4] ..... B65D 5/70

[52] U.S. Cl. ..... 206/611; 206/605; 206/620; 229/17 R

[58] Field of Search ..... 229/17 R, 17 G, 37 R; 206/611, 620, 621, 622, 605, 608

[56] References Cited

U.S. PATENT DOCUMENTS

| | | | |
|---|---|---|---|
| 2,465,949 | 3/1949 | Williamson | 229/38 |
| 3,040,950 | 6/1962 | Kuchenbecker | 229/17 R |
| 3,040,951 | 6/1962 | Kuchenbecker | 229/17 G |
| 3,232,514 | 2/1966 | Swede et al. | 229/17 R |
| 3,333,758 | 8/1967 | Buchner | 229/17 R |
| 3,386,323 | 6/1968 | Dovey | 83/470 |
| 3,401,608 | 9/1968 | Labombarde | 93/36 |
| 3,404,988 | 10/1968 | Rausing | 99/171 |
| 3,471,991 | 10/1969 | Rausing | 53/27 |
| 3,654,842 | 4/1972 | Schwenk | 93/94 PS |
| 3,719,548 | 3/1973 | Keck et al. | 161/117 |
| 3,795,359 | 3/1974 | Rausing | 229/7 R |
| 3,797,726 | 3/1974 | Reil | 229/17 R |
| 3,869,078 | 3/1975 | Braun | 229/17 R |
| 4,078,715 | 3/1978 | Larsson et al. | 229/17 R |
| 4,093,115 | 6/1978 | Bachner et al. | 229/17 G |
| 4,135,438 | 1/1979 | Sugioka | 93/1 G |
| 4,248,351 | 2/1981 | Berg | 206/620 |
| 4,327,833 | 5/1982 | Kuchenbecker | 229/17 R X |
| 4,343,402 | 8/1982 | Holstrom | 206/622 |
| 4,362,245 | 12/1982 | Kuchenbecker | 229/17 R X |

FOREIGN PATENT DOCUMENTS

| | | | |
|---|---|---|---|
| 714414 | 7/1965 | Canada | 229/17 G |
| 14272 | 8/1980 | European Pat. Off. | 229/17 R |
| 300093 | 6/1968 | Sweden | 229/17 R |
| 315243 | 9/1969 | Sweden | 229/17 G |
| 1134847 | 11/1968 | United Kingdom | 229/17 R |

*Primary Examiner*—William Price
*Assistant Examiner*—Gary E. Elkins
*Attorney, Agent, or Firm*—Finnegan, Henderson, Farabow, Garrett & Dunner

[57] ABSTRACT

A liquid tight carton with a pour spout having a tear-off portion separated from spout edge forming panels, and panels forming a top fin seal, by lines of structural weakness. The spout of the castor is formed from extended portions of the sidewalls and one end wall. The outer surface of the top is comprised of the extended portion of a sidewall with an opening disposed to allow grasping of the tear-off portion in one corner of the top.

11 Claims, 7 Drawing Figures

TEAR STRIP END CLOSURE ON LIQUID TIGHT CARTON

BACKGROUND OF THE INVENTION

The present invention relates to cartons generally formed of paperboard and capable of holding liquid products. Typical cartons have a core structural layer of paperboard providing the carton's strength and rigidity. A layer of aluminum foil is adhered to one surface of the paperboard and serves as a barrier layer against passage of contaminants into the package. Both outer surfaces of the paperboard/foil combination are then coated with heat sealable plastic. While a number of specific constructions are known, it is generally accepted practice to close the carton openings with seals wherein surfaces of the plastic which face the interior of the carton are brought into face-to-face contact along opposing edges and sealed together, in most cases forming a fin. Such a structure (using an interior plastic sealing layer) is disclosed in U.S. Pat. No. 4,327,833 to Kuchenbecker.

That patent discloses an improved carton opening that does not require the use of cutting means (knives, scissors, etc.) to open the carton. The patented carton has a fin seal with two opposing edge flaps projecting above lines of weakness. The edges are adhered together with the lines of weakness in registry to form a protecting member that is torn at the line of weakness to open the carton. Such liners render the carton liquid tight but complicate manufacture of the carton and make opening such cartons difficult. Because such cartons are mass produced and should be liquid tight, moisture resistant, easily opened and readily manufactured, there exists a demand for improved cartons of this type, especially those having only a plastic coating rather than a separate plastic liner.

Therefore, it is a principal object of the present invention to provide a carton having a readily opened pour spout that is liquid tight and moisture resistant.

It is a further object of the invention to provide a carton with a pour spout that can be readily manufactured in bulk quantities.

It is an additional object of the present invention to provide a carton having a pour spout opened by tearing along a line of weakness that forms an edge on the spout that resists dribbling of liquid poured from the spout.

Other objects of the invention will be described in the description of the preferred embodiment or may be apparent therefrom.

SUMMARY OF THE INVENTION

The above-noted objects of the invention are obtained by means of a liquid tight carton constructed from a structural carton material that includes a heat sealing material on its inner surface. The carton comprises a bottom, upstanding opposite sidewalls, and end panels joined to the sidewalls along fold lines. The end panels and sidewalls have portions that form the top of the carton. The end panels are comprised of a sealing end and a spout forming end. The spout forming end is in turn comprised of lower spout forming panels, intermediate spout edge panels and upper tear-off portions. The intermediate spout edge panels are connected to the spout forming panels along fold lines. The upper tear-off portions are comprised of opposite panels disposed to be adhered one to the other to seal the carton. The tear-off portions are also connected to the spout edge portions at a line of structural weakness such that tearing off the tear-off portions at the line of structural weakness opens the carton. The opposite sidewalls each have an upper portion on the end of the carton opposite the bottom. The upper portions each are comprised of a top closure connected to the sidewall along a sidewall fold line. The top closure is disposed to close the top of the carton. Each of the top closures include a lower panel, each having one portion which comprises a sidewall spout forming panel connected at a spout sidewall fold line to an adjacent lower spout forming panel in the end panel. A second portion of the lower closure panel comprises the remainder of the lower closure panel. The top closure further includes an upper sealing panel disposed to be adhered to an opposite upper sealing panel which is comprised of a spout edge forming portion connected along a fold line to the spout forming panel. The tear-off portion adjacent and above the spout edge forming panel is connected thereto by a line of structural weakness. The upper sealing panel includes a rear sealing portion between the tear-off portion and the sealing end of the end panel. The upper sealing panel is also connected to the tear-off portions by a line of structured weakness. The rear sealing portion is disposed to be adhered to the second portion of the lower closure to seal the carton. The tear-off portion is also adjacent the spout end of the rear sealing portion and affixed thereto by a line of structural weakness. The upper portion of the carton is constructed such that when the rear sealing portion is adhered to the second portion of the lower closure, the tear-off portion of the upper sealing panel is adhered to the second portion of the lower closure and the sidewall spout forming panel such that removal of all of the tear-off panels along the lines of structural weakness allows the spout to be opened.

Preferably, the lines of structural weakness in the carton are comprised of grooves formed by removing carton material to a depth less than the total thickness of the carton. It is also preferred to remove the carton material mechanically to form the grooves. It is further preferred that the spout be in the form of a gabled spout comprised of panels in the shape of equilateral triangles. Other preferred embodiments of the present invention will be set out in the detailed description of the preferred embodiments.

DETAILED DESCRIPTION OF THE PREFERRED EMBODIMENTS

Figure 1:
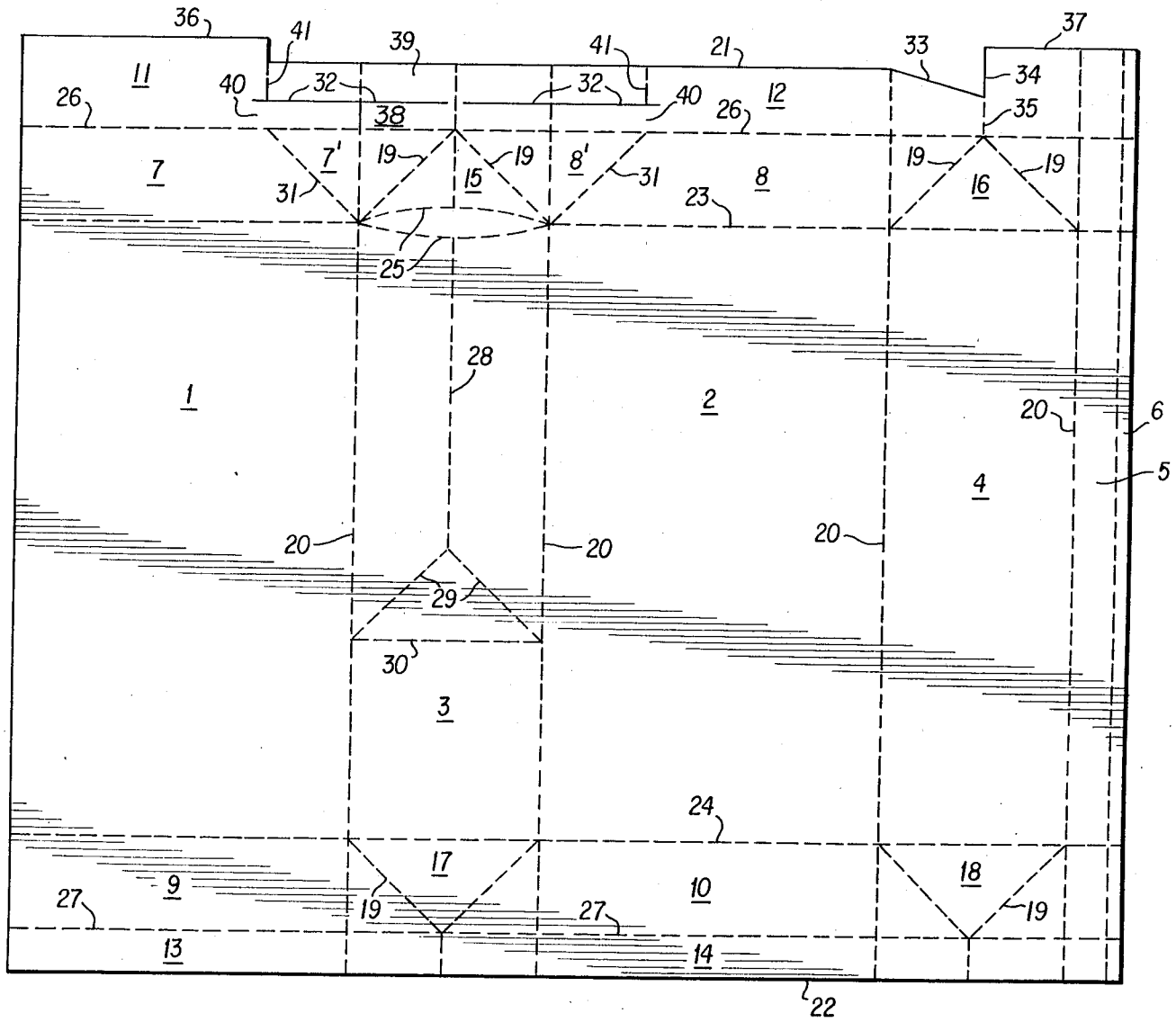
FIG. 1 is a plan view of a blank depicting one embodiment of the present invention.

FIG. 1 depicts a flat carton blank having layers of heat sealing plastic on both sides. The blank has two main sidewalls 1 and 2, two end panels 3 and 4 and a side seam 5. An area 6 the full length of the side seam is skived and hemmed during the heat seal side seaming of the blank. Additionally, the carton blank has two top panels 7 and 8 and two bottom panels 9 and 10. Panels 11 and 12 are extensions of top panels 7 and 8 and panels 13 and 14 are extensions of bottom panels 9 and 10. The blank also has extensions 15, 16, 17, 18 of end panels 3 and 4. Each end panel extension has two diagonal crease lines 19 in each panel. The main sidewalls 1 and 2 and end panels 3 and 4 have vertical crease hinge lines 20 which extend between cut lines 21 and 22 and horizontal crease hinge lines 23 and 24 which extend through panels 1, 2, 3, 4 and side seam 5. It should be noted that horizontal crease hinge line 23 does not extend through end panel 3. End panel 3 and the spout forming panels 15 are divided by two arched creases 25. Top panels 11, 12, 7 and 8 (comprising the top closure) are divided by crease hinge line 26 and bottom panels 9, 10, 13 and 14 are divided by crease hinge line 27. End panel 3 has a vertical line 28 starting from cut line 21 and intersects with diagonal crease lines 29. Those crease lines also intersect vertical crease line 28 and horizontal crease line 30. Top panels 7 and 8 have diagonal crease lines 31 separating the second portion of the lower panel from the spout forming panels 7 and 8. Rear upper sealing panels 11 and 12 and spout forming panel 15 of end panel 3 has a cut line 32 which terminates short of each side of vertical crease line 28.

This cut line is made during the printing operation. After printing, the web of cartons receives an overall lamination of foil on the inside and an extruded heat sealable coating over the foil and, in a preferred embodiment on the outside as well.

The cartons printed within the web are now die cut. During the heat seal side seaming, the area 6 is skived and hemmed onto the outside of seam side 5. This eliminates the raw edge of board on the inside of the carton. End panel 4 is folded on hinge crease line 20 between end panel 4 and sidewall 2. Sidewall panel 1 is folded on hinge crease line 20 between sidewall panel 1 and end panel 3. The heat seal side seam is completed and the carton is ready to be shipped to the point of packaging. The carton bottom is sealed in a conventional manner as for example the manner shown in FIG. 10 of U.S. Pat. No. 4,327,833.

After filling, the top panels 7 and 8 are folded inward along hinge crease line 23. Spout forming panel 15 and end panel 16 are folded outward on diagonal crease lines 19. Top upper sealing panels 11 and 12 are folded to a vertical on hinge crease line 26 at which time come together in an inside surface face-to-face abutment. Heat sealing of this surface will be effected along the entire length of the vertical fin and slightly above cut line 32. A cutout area along the diagonal cut of line 33 which intersects at vertical cut 34 and a vertical crease extension 35 of diagonal crease lines 19 is at that intersection point about 3/16" above cut line 32 to ensure sufficient area for a liquid tight seal. It should be noted that rear upper sealing panel 11 and the upper portions of end panel 4 have a cut line 36 and 37 which is above cut line 21. If there were no heat sealing coating on the outside of the carton, the coated inside surface is exposed and can be sealed to the outside surface. If, however, both surfaces are coated with heat sealing material then the heat seal bond is stronger.

With the fin seal completed, upper sealing panels 11 and 12 are folded down on hinge crease line 26 and the exposed inside area of 36 and 37 above cut line 21 will be sealed to top panel 8. Spout forming panel 15 is spot sealed to end panel 3. End panel 16 is sealed to end panel 4. The cutout area along cut line 33 has an enlarged area for additional sealing.

Figure 2:
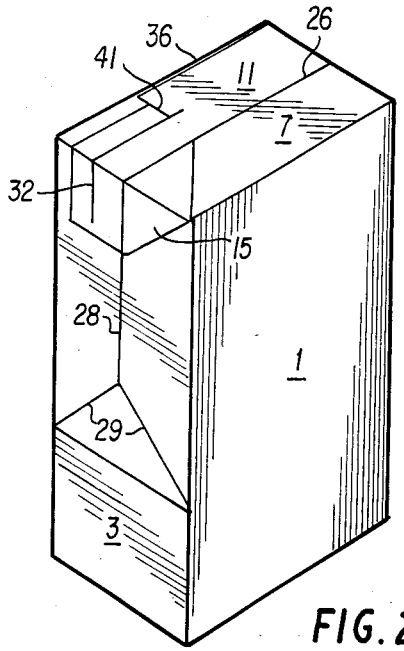
FIG. 2 is a perspective view of the embodiment of FIG. 1 showing the carton in its completely sealed configuration.
Figure 3:
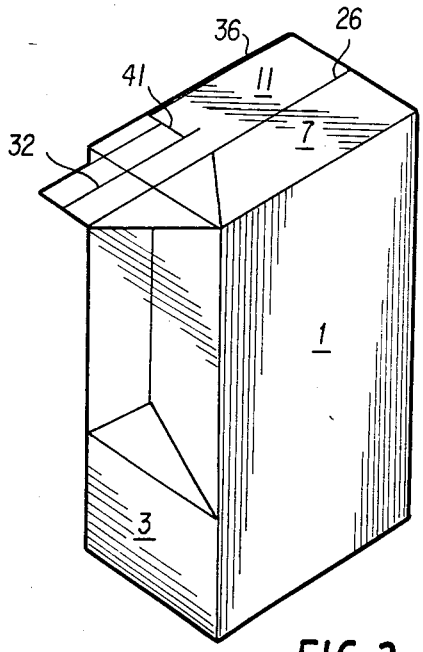
FIG. 3 is a perspective view of the embodiment of FIGS. 1 and 2 showing a partial opening of the carton.
Figure 4:
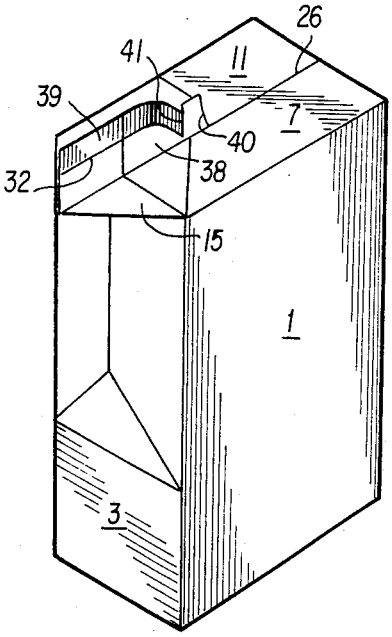
FIG. 4 is a perspective view of the embodiments of FIGS. 1 through 3 depicting the removal of the tear-off portion to open the spout.
Figure 5:
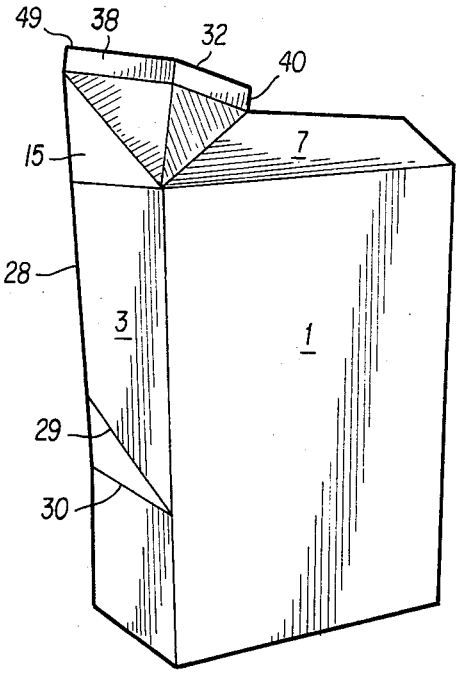
FIG. 5 is a perspective view of the carton of FIGS. 1 through 4 depicting the spout in an open configuration.

The carton, completely sealed is shown in FIG. 2. To open the carton the spot heat seal bond of spout forming panel 15 is broken as shown in FIG. 3. The spout edge forming panels 38 of the upper sealing panels 11 and 12 and the tear-off portion 39 above the line of structural weakness, here cut line 32, is folded upward along hinge crease line 26 at which time the paperboard will tear on a non-cut line area 40 down to hinge crease line 26. Cut line 32 extends past vertical cut lines 41. This will allow tear-off portion 39 to begin tearing forward of the end of the cut 32 preventing a tear that could otherwise begin along hinge crease line 26. The tear-off portion 39 is removed along cut line 32. The material to be torn is only the foil and the extruded heat seal coating ensuring a very positive and easy removal of tear-off portion 39 as shown in FIG. 4.

As noted earlier, cut line 32 terminates short of each side of vertical crease line 28. When tear-off portion 39 is removed, the uncut portion will tear and provide a tit 49 that substantially reduces the tendency of liquid being poured slowly from a full carton to cling to the carton and dribble down along the end wall. See U.S. Pat. No. 4,327,833, Column 7, Paragraph 3.

When the spout is fully opened, squeezing the two top corners of sidewalls 1 and 2 will cause crease line 28 to break in combination with crease lines 29 and 30 thereby forming a trough which will elongate the spout into a full dispensing guide. See U.S. Pat. No. 3,040,950, Column 4, Paragraph 2, U.S. Pat. No. 3,040,951, Column 3, paragraph 3, U.S. Pat. No. 3,107,038, Column 3, Paragraph 4, and U.S. Pat. No. 4,362,245, the disclosures of which are incorporated by reference.

Figure 6:
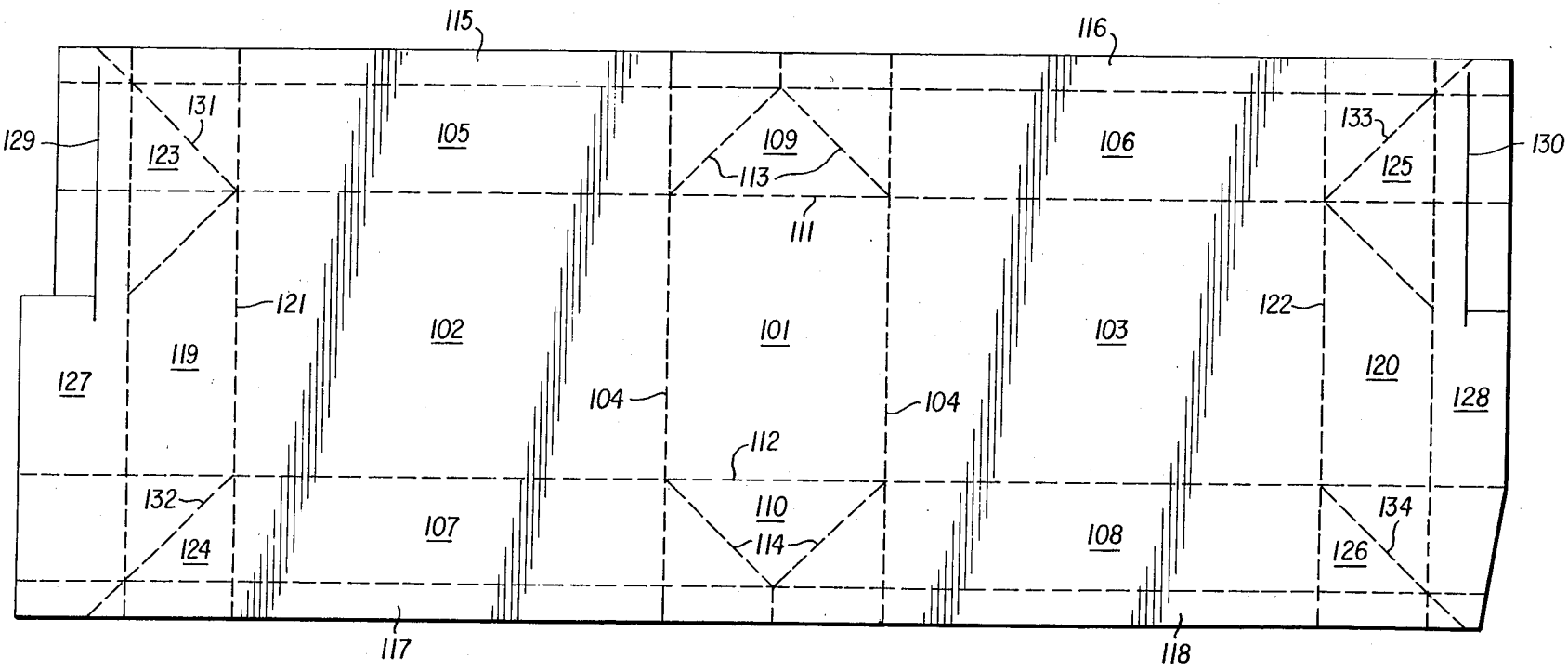
FIG. 6 is a plan view of a blank showing another embodiment of the invention.

An alternate embodiment to this structure is shown in FIG. 6 as a flat blank. The structure as shown in FIGS. 1, 2, 3, 4, and 5 is one that would be side seam sealed at the point of manufacture. The blank shown in FIG. 6 would have the spout opening line of weakness cut during printing, receive a foil lamination on the inside and an extruded heat sealable coating over the foil and on the outside. After die cutting the carton blanks would be ready to ship to the point of packaging. At that point, the carton blank is formed around a mandrel. With the bottom of the carton 101 in contact with the bottom of the mandrel main sidewalls 102 and 103 fold upward on hinge crease lines 104. End panels 105, 106, 107 and 108 fold in and around the sides of the mandrel. At the same time, panels 109 and 110 of bottom panel 101 fold downward on hinge/crease lines 111 and 112 and diagonal creases 113 and 114 fold forming a web. At this point, panels 115, 116, 117 and 118 of end panels 105, 106, 107 and 108 are folded outward. A face-to-face heat seal is made along the entire length of panels 115, 116, 117 and 118. These panels are sealed against the outside of end panels 106 and 108. The web panels 109 and 110 are folded up 180° and sealed against the outside of panels 115 and 117. The body of this structure is now formed and ready for filling.

After filling, the top panels 119 and 120 are folded inward on hinge crease lines 121 and 122. At the same time, spout forming panel 123 and sealing panel 124 of panels 105, 119 and 107 and spout forming panel 125 and sealing panel 126 of panels 106, 120 and 108 are folded outward. At this time, there is a face-to-face abutment of upper sealing panels 127 and 128 of top panels 119 and 120. At this point, these panels are folded on hinge crease lines 121 and 122 about 80° downward toward top panel 120 and then heat sealed together in a horizontal line slightly above cut lines 129 and 130. It is the forming nature of extensions 115, 116, 117 and 118 at the outside termination of diagonal crease lines 131, 132, 133 and 134 that requires the 180° downward fold of top sealing panels 127 and 128 before a heat seal can be made. The top sealing panels are sealed against the outside of panels 115 and 117 as on the bottom.

Figure 7:
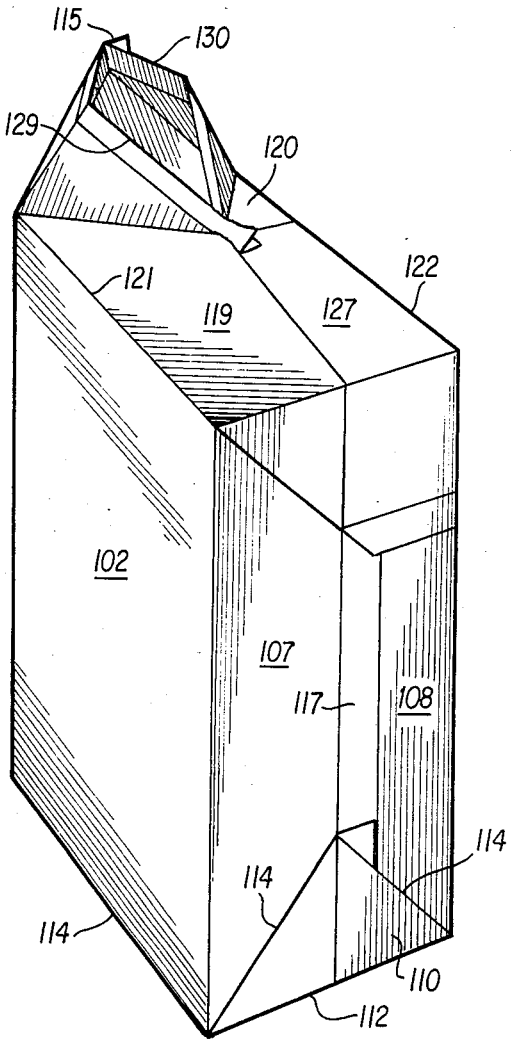
FIG. 7 is a perspective view of the embodiment of FIG. 6 with the spout fully opened.

In this embodiment top sealing panel 127 is wider and projects above top sealing panel 128 in order to allow exposure of the inside surface to be sealed to the outside of top panel 120. The opening and function of the top and pour spout is similar to that shown in FIGS. 4 and 5. FIG. 7 shows a carton like that depicted in FIG. 6 completely set up and opened to illustrate the appearance and various folds and seals.

The various interior lines of structural weakness may be formed by die cutting the blank, by mechanically removing a narrow layer of paperboard or by burning away a narrow layer of paperboard by means of laser radiation. Preferably the line of structural weakness is formed by routing a channel into the outer surface of the blank. When such a line of structural weakness is torn, it forms upstanding fibers that lift the liquid being poured over the edge and prevent it from dribbling down the end wall and spout.

What is claimed is:

1. A liquid tight carton constructed from a structural carton material, said material including a heat sealing material at least on the inner surface thereof, said carton comprising:

a bottom;

upstanding opposite sidewalls; and end panels joining said sidewalls along fold lines, said end panels comprising a sealing end panel portion defining a sealing end of the carton and a spout end panel portion defining a spout end of the carton, said spout end panel portion comprising lower spout forming panels, intermediate spout edge portions, and upper end panel tear-off portions, said intermediate spout edge portions being connected to said lower spout forming panels along fold lines, said upper end panel tear-off portions being comprised of opposite panels disposed to be adhered one to the other to seal the carton, said end panel tear-off portions also being connected to said spout edge portions at a line of structural weakness such that tearing off said upper end panel tear-off portions at said line of structural weakness opens said carton;

said opposite sidewalls comprising a first sidewall and a second side wall;

said first sidewall comprising a first upper carton portion on the extremity of the carton opposite said bottom, said first upper carton portion comprising a first top closure connected to the remainder of said first side wall along a side wall fold line, said first top closure including a first lower panel, said first lower panel including a first side wall spout forming panel, and a remaining first lower panel portion, said first sidewall spout forming panel connected at a spout side wall fold line to an adjacent lower spout forming panel in said spout end panel portion;

said first top closure also including a first upper sealing panel, said first upper sealing panel being comprised of a first sidewall spout edge forming portion connected along a fold line to said first side wall spout forming panel, a first side wall tear-off portion adjacent and above said first sidewall spout edge forming portion and connected thereto by a line of structural weakness, said first side wall tear-off portion having a first upper side wall tear-off portion free edge, said first upper sealing panel including a first rear sealing portion between said first side wall tear-off portion and said sealing end panel portion, said first rear sealing portion having a first upper rear sealing portion free edge, said first rear sealing portion also being connected to said first side wall tear-off portion by a line of structural weakness, said first upper rear sealing portion free edge being spaced above said first upper side wall tear-off portion free edge to facilitate initial tearing along the line of structural weakness between said first rear sealing portion and said first side wall tear-off portion;

said second side wall comprising a second upper carton portion on the extremity of the carton opposite said bottom, said second upper carton portion comprising a second top closure connected to the remainder of said second side wall along a side wall fold line, said second top closure including a second lower panel, said second lower panel including a second side wall spout forming panel and a remaining second lower panel portion, said second side wall spout forming panel connected at a spout side wall fold line to an adjacent lower spout forming panel in said spout end panel portion;

said second top closure also including a second upper sealing panel, said second upper sealing panel being comprised of a second side wall spout edge forming portion connected along a fold line to said second side wall spout forming panel, a second side wall tear-off portion adjacent and above said second side wall spout edge forming portion and connected thereto by a line of structural weakness, said second upper sealing panel including a second rear sealing portion between said second sidewall tear-off portion and said sealing end panel portion, said second rear sealing portion also being connected to said second side wall tear-off portion by a line of structural weakness;

said first top closure and said second top closure being disposed to close the top of said carton, said first upper sealing panel disposed to be adhered to said second upper sealing panel, one of said first and second rear sealing portions disposed in a surface to surface relationship with one of said remaining first and second lower panel portions and bonded thereto.

2. The carton of claim 1 wherein the outer portion of the top of said carton, when said carton is erected and sealed, is primarily comprised of the upper portion of one of said sidewalls.

3. The carton of claim 2 wherein the portion of the top of said carton not comprised of one of said sidewalls is an exposed portion of the opposite sidewall, said exposed portion being adjacent said sidewall tear-off portions and one of the rear sealing portions.

4. The carton of claim 1 wherein said structural lines of weakness are comprised of grooves formed by removing carton material to a depth less than the total thickness of said carton.

5. The carton of claim 1 wherein the lines of structural weakness on said tear-off portions are disposed to form projecting fibers at the edge created by removal of the tear-off portions at said lines of structural weakness.

6. The carton of claim 1 wherein said first rear sealing portion is larger than said second rear sealing portion by an excess portion, the inside surface of said excess portion disposed in a surface-to-surface relationship with said remaining second lower panel portion when the carton is erected and sealed.

7. The carton of claim 1 wherein the sealing end portion comprises an upper sealing end on the extremity of the carton opposite the bottom, said upper sealing end having first and second upper end seal portions, said first upper end seal portion being larger than said second upper end seal portion by an extending portion, the inside surface of said extending portion disposed to be adhered to the sealing end panel portion when the carton is erected and sealed.

8. The carton of claim 1 wherein the line of weakness between the first side wall tear-off portion and the second first side wall spout edge forming portion crosses and extends past the line of weakness between the first rear sealing portion and the first side wall tear-off portion.

9. The carton of claim 1 wherein the line of weakness between the second side wall tear-off portion and the second side wall spout edge forming portion crosses and extends past the line of weakness between the first rear sealing portion and the first side wall tear-off portion.

10. The carton of claim 9 wherein the line of weakness between the first side wall tear-off portion and the first side wall spout edge forming portion crosses and extends past the line of weakness between the first rear sealing portion and the first side wall tear-off portion.

11. The carton of claim 1 wherein said first upper rear sealing portion free edge is in register with said remainder of the second side wall.

* * * * *